US009543631B1

(12) United States Patent
Antkowiak

(10) Patent No.: US 9,543,631 B1
(45) Date of Patent: Jan. 10, 2017

(54) TAPERED AIRLINE DIRECTIONAL COUPLER

(71) Applicant: Marek E. Antkowiak, Lake Hopatcong, NJ (US)

(72) Inventor: Marek E. Antkowiak, Lake Hopatcong, NJ (US)

(73) Assignee: R & D Microwaves, LLC, Boonton, NJ (US)

( * ) Notice: Subject to any disclaimer, the term of this patent is extended or adjusted under 35 U.S.C. 154(b) by 0 days.

(21) Appl. No.: 14/843,536

(22) Filed: Sep. 2, 2015

(51) Int. Cl.
*H01P 5/18* (2006.01)
*H01R 9/05* (2006.01)
*H01P 5/12* (2006.01)

(52) U.S. Cl.
CPC .. *H01P 5/18* (2013.01); *H01R 9/05* (2013.01)

(58) Field of Classification Search
CPC ..... H01P 5/18; H01P 5/183
USPC ..... 333/109–113, 115
See application file for complete search history.

(56) References Cited

U.S. PATENT DOCUMENTS 6,066,994 A 5/2000 Shepherd et al.
6,400,235 B1 * 6/2002 Perez ..... H03C 3/40 329/304
6,573,807 B2 6/2003 Noe
6,600,307 B2 7/2003 Geller et al.
7,002,433 B2 2/2006 Antkowiak et al.
7,026,888 B2 * 4/2006 Antkowiak ..... H01P 5/183 333/121
7,429,903 B2 9/2008 Antkowiak

* cited by examiner

*Primary Examiner* — Dean Takaoka

(74) *Attorney, Agent, or Firm* — St Onge Steward Johnston and Reens LLC

(57) ABSTRACT

A tapered airline directional coupler includes a housing having a length with an input end and an output end, the housing having a slot formed therein extending between the input end and the output end. The coupler also includes a main conductor in electrical communication with an input port connector mounted on the housing at the input end thereof and with an output port connector mounted on the housing at the output end thereof, and a coupled conductor in electrical communication with and extending between a forward coupling port connector mounted on the housing adjacent to the input end thereof and a reverse coupling port connector mounted on the housing adjacent to the output end thereof. Each of the slot, the main conductor and the coupled conductor has a cross-sectional area that varies depending upon where the cross-section is taken along the length of the housing.

22 Claims, 5 Drawing Sheets

TAPERED AIRLINE DIRECTIONAL COUPLER

FIELD OF THE INVENTION

The present invention relates generally to directional couplers, and more specifically to high power, low passive intermodulation (PIM), low loss, wide bandwidth directional couplers.

BACKGROUND OF THE INVENTION

The term "directional coupler" refers in general to a four-port, or a three-port when internally terminated, passive microwave device, where a main line conductor (also called the "through" line) carries radio frequency (RF) power. The main line conductor is in close proximity and is coupled to a secondary conductor by the electromagnetic field generated by the RF signal. The RF current flowing forward through the main line will induce RF current flow in the coupled conductor flowing in the opposite direction, and will only appear at one of the coupled ports (i.e., a signal current flowing from left to right on the main line will induce a signal current flowing from right to left in the coupled conductor and appear only from the left coupled output). As a result, the coupled output of forward and reverse flow of RF current, on the main line, will appear at different coupled outputs.

Many different designs for directional couplers, including both single and dual directional couplers, have been historically known, for example, from U.S. Pat. Nos. 6,066,994, 6,573,807 and 6,600,307. However, the directional couplers disclosed in these references suffer from a number of disadvantages, particularly in their design and their manufacturability.

U.S. Pat. No. 7,429,903 represented a significant advancement over the theretofore known designs, in providing an airline directional coupler that exhibited relatively high power, relatively low passive intermodulation (PIM), relatively low loss, and relatively wide bandwidth, all in a package that was relatively simple in design and relatively inexpensive and easy to manufacture. Though U.S. Pat. No. 7,429,903 was specifically directed to a dual directional coupler, the teachings thereof would be applicable to a single directional coupler.

However, while U.S. Pat. No. 7,429,903 was indeed an advancement over the prior art thereto, the teachings thereof still suffer from significant disadvantages. For example, although the frequency bandwidth of the design disclosed in U.S. Pat. No. 7,429,903 was relatively wide, as compared to historical designs, it still resulted in limitations. More specifically, the stepped configuration taught be U.S. Pat. No. 7,429,903 is frequency limited by the number of ¼ wave sections or 'n-sections', and is not practical to implement for a large number of sections.

What is desired, therefore, is a high power, low passive intermodulation (PIM), low loss, wide bandwidth airline directional coupler that is relatively simple in design and relatively inexpensive and easy to manufacture as compared to known designs, while at the same time also providing for wider bandwidth than has heretofore known designs.

SUMMARY OF THE INVENTION

In accordance with one aspect of the present invention, a tapered airline directional coupler includes a housing having a length with an input end and an output end disposed at opposite ends of the length, the housing having a slot formed therein extending between the input end and the output end. A cross-sectional area of the slot varies depending upon where the cross-section is taken along the length of the housing. The directional coupler also includes a main conductor disposed within the slot and extending between the input end and the output end of the housing, the main conductor being in electrical communication with an input port connector mounted on the housing at the input end thereof and with an output port connector mounted on the housing at the output end thereof. The main conductor has a cross-sectional area that varies depending upon where the cross-section is taken along the length of the housing. Additionally, the directional coupler includes a coupled conductor disposed within the slot and spaced apart from the main conductor, the coupled conductor being in electrical communication with and extending between a forward coupling port connector mounted on the housing adjacent to the input end thereof and a reverse coupling port connector mounted on the housing adjacent to the output end thereof. The coupled conductor has a cross-sectional area that varies depending upon where the cross-section is taken along the length of the housing.

In some embodiments, the slot comprises a lower section with a generally round cross-section that receives the main conductor, and an upper section with a generally rectangular cross-section that receives the coupled conductor. In certain of these embodiments, the lower section of the slot has a substantially constant diameter along the length of the housing. In certain embodiments, a width of the upper section of the slot tapers from a larger width adjacent to the input end of the housing to a smaller width adjacent to the output end of the housing. In certain embodiments, an overall depth of the slot is generally constant along the length of the housing.

In some embodiments, the main conductor has a generally circular cross-section regardless of where the cross-section is taken along the length of the housing, and a diameter of the main conductor varies depending upon where the cross-section is taken along the length of the housing. In certain of these embodiments, the diameter of the main conductor has a taper from a larger diameter toward a middle of the length of the housing toward smaller diameters toward both the input end of the housing and the output end of the housing. In certain embodiments, the diameter of the main conductor is larger at the output end of the housing than at the input end of the housing. In certain embodiments, the main conductor is positioned within the slot at a substantially constant depth along the length of the housing.

In some embodiments, the coupled conductor has a generally rectangular cross-section regardless of where the cross-section is taken along the length of the housing. In certain of these embodiments, a thickness of the coupled conductor remains substantially constant regardless of where the cross-section is taken along the length of the housing. In certain embodiments, a height of the coupled conductor tapers from a larger height adjacent to the input end of the housing to a smaller height adjacent to the output end of the housing. In certain embodiments, a depth of an edge of the coupled conductor opposite to the main conductor within the slot remains substantially constant along the length of the housing.

In some embodiments, the main conductor and the coupled conductor each comprise a solid, one-piece rod. In some embodiments, the cross-sectional shape of the main conductor is round, in some embodiments, it is rectangular and in some embodiments, it is of another polygonal shape.

In accordance with another aspect of the present invention, a tapered airline directional coupler includes a housing having a length with an input end and an output end disposed at opposite ends of the length, the housing having a slot formed therein extending between the input end and the output end, the slot having a lower section with a generally round cross-section and an upper section with a generally rectangular cross-section. A width of the upper section of the slot tapers from a larger width adjacent to the input end of the housing to a smaller width adjacent to the output end of the housing. The coupler also includes a main conductor disposed within the lower section of the slot and extending between the input end and the output end of the housing, the main conductor being in electrical communication with an input port connector mounted on the housing at the input end thereof and with an output port connector mounted on the housing at the output end thereof, the main conductor having a generally circular cross-section regardless of where the cross-section is taken along the length of the housing. The diameter of the main conductor has a taper from a larger diameter toward a middle of the length of the housing toward smaller diameters toward both the input end of the housing and the output end of the housing. Additionally, the coupler includes a coupled conductor disposed within the upper section of the slot and spaced apart from the main conductor, the coupled conductor being in electrical communication with and extending between a forward coupling port connector mounted on the housing adjacent to the input end thereof and a reverse coupling port connector mounted on the housing adjacent to the output end thereof, the coupled conductor having a generally rectangular cross-section regardless of where the cross-section is taken along the length of the housing. A height of the coupled conductor tapers from a larger height adjacent to the input end of the housing to a smaller height adjacent to the output end of the housing.

The invention and its particular features and advantages will become more apparent from the following detailed description considered with reference to the accompanying drawings.

DETAILED DESCRIPTION OF AN EMBODIMENT OF THE INVENTION

Figure 1:
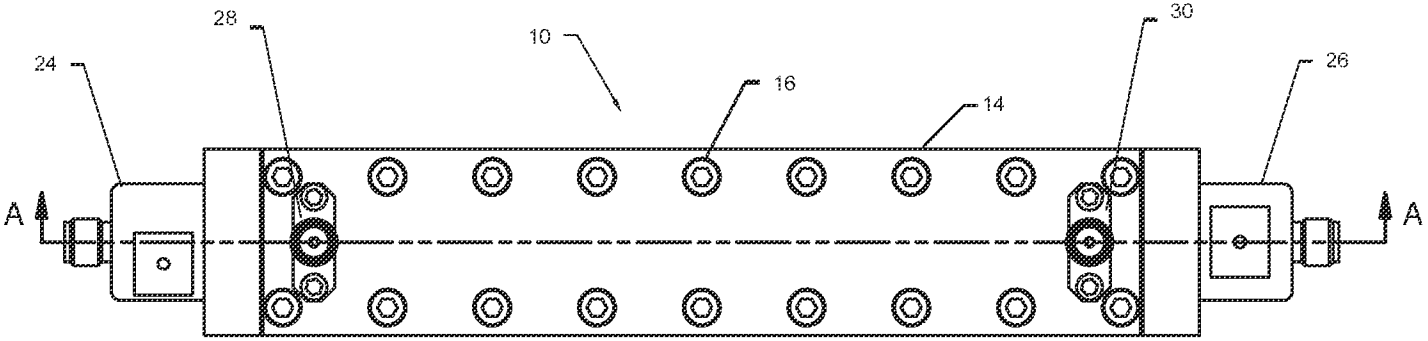
FIG. 1 is a top plan view of a directional coupler in accordance with an exemplary embodiment of the present invention.
Figure 2:
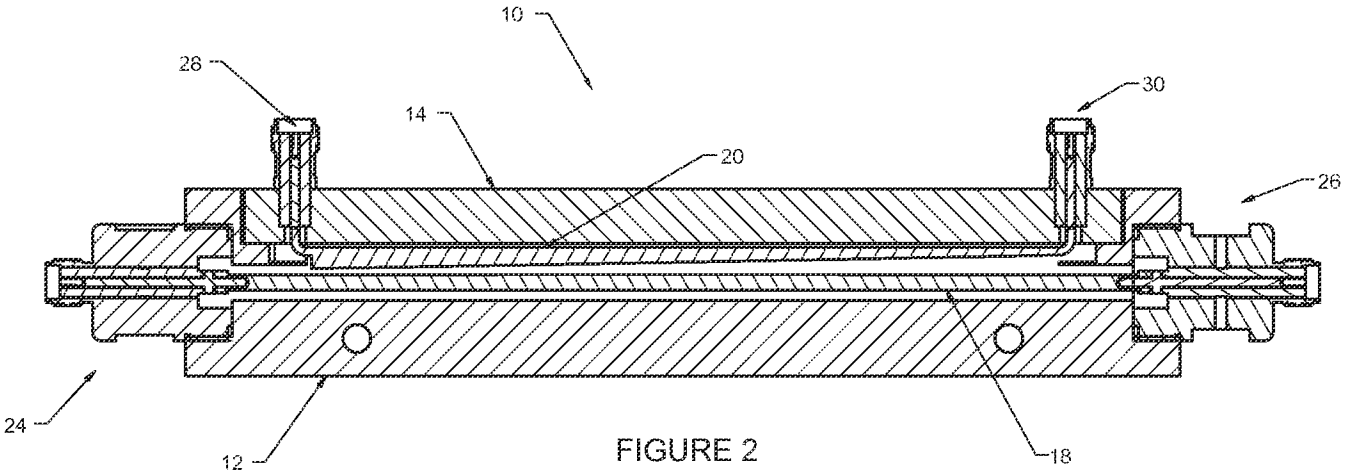
FIG. 2 is a cross-sectional side view of the directional coupler taken along line A-A in FIG. 1.
Figure 3:
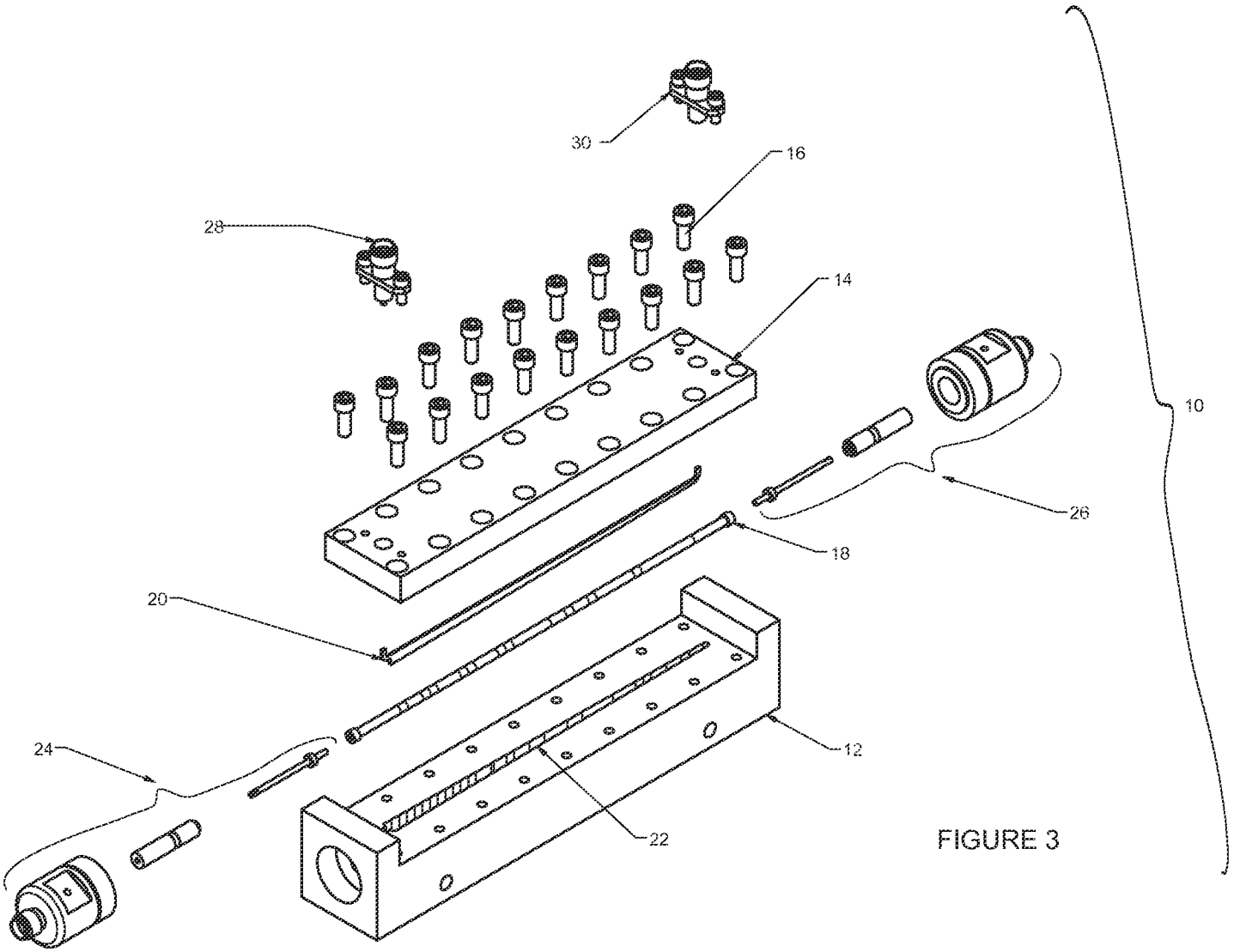
FIG. 3 is an isometric exploded view of the directional coupler of FIG. 1.

Referring first to FIGS. 1-3, a directional coupler (10) in accordance with an exemplary embodiment of the present invention is shown. The directional coupler (10) includes a housing (12), having a cover (14) affixed thereto using a plurality of fasteners (16), such as screws, bolts, rivets or the like. The directional coupler (10) also includes a main conductor (18), and a coupled conductor (20), also known as a secondary conductor.

The main conductor (18) is disposed within a slot (22) inside the housing (12) and is supported in a spaced arrangement with respect to the walls of the slot (22) by way of the insulator supports that form part of an input port connector (24) and an output port connector (26). The input port connector (24) and the output port connector (26) are electrically connected to the main conductor (18) and provide a path for the main power flow through the directional coupler (10). The input port connector (24) and the output port connector (26) may comprise coaxial connectors. As various connectors and means for supporting a main conductor within a slot in a housing are well-known in the art, further details of this aspect of the exemplary embodiment are not provided herein.

The coupled conductor (20) is also disposed within the slot (22) inside the housing (12) and is supported in a spaced arrangement with respect to the walls of the slot (22), and with respect to the main conductor (18) by way of the insulator supports that form part of a forward coupling port connector (28) and a reverse coupling port connector (30). The forward coupling port connector (28) and the reverse coupling port connector (30) are electrically connected to the coupled conductor (20) and provide a means for measuring sampled power flow through the directional coupler (10). The forward coupling port connector (28) and the reverse coupling port connector (30) may comprise coaxial connectors. As various connectors and means for supporting a coupled conductor within a slot in a housing are well-known in the art, further details of this aspect of the exemplary embodiment are not provided herein.

As known in the art, a small amount of the power flowing through the main conductor (18) in the forward direction (i.e., from the input port connector (24) to the output port connector (26)) will be coupled to the coupled conductor (20) and be available at the forward coupling port connector (28). Respectively, a small amount of the power flowing through the main conductor (18) in the reverse direction (i.e., from the output port connector (26) to the input port connector (24)) will be coupled to the coupled conductor (20) and be available at the reverse coupling port connector (30).

Figure 4:
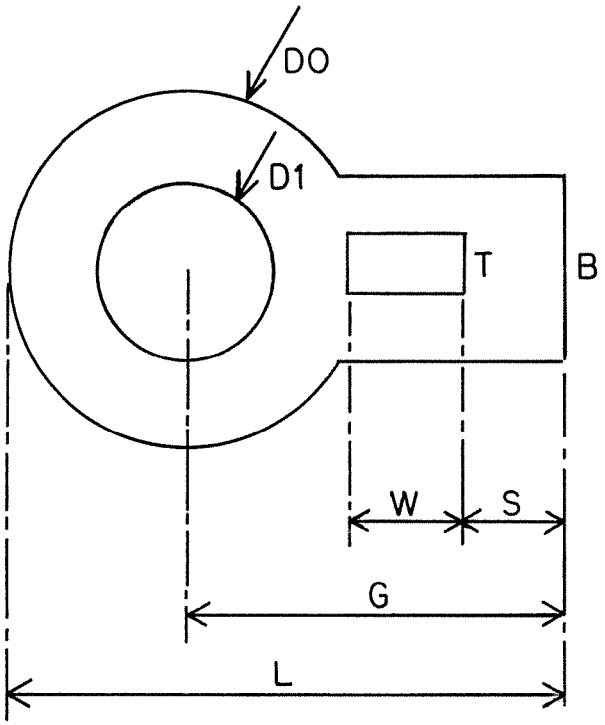
FIG. 4 is a schematic view illustrating, in conjunction with Table 1, the dimensions of various components of the directional coupler of FIG. 1 along the length thereof.

With respect specifically now to FIG. 4 and Table 1 below, the dimensions of various components of the directional coupler (10) are shown. It should be understood that FIG. 4 is a schematic view illustrating the dimensions of various components of the directional coupler (10) of FIG. 1 along the length thereof. Specifically, No. 1 in Table 1 references the dimensions of various components adjacent to the side of input port connector (24), while No. 41 in Table 1 references the dimensions of various components adjacent to the output port connector (26). Also, it should be pointed out that while the various components with changing dimensions are continuously tapered, in practice, they can be modeled as having a finite number of sections (as shown in Table 1).

TABLE 1

| Dimensions of various components | | | | |
|---|---|---|---|---|
| No. | K (dB) | D1 | W | B |
| 1 | −14.05 | 82.95 | 115.10 | 159.95 |
| 2 | −14.45 | 83.10 | 113.65 | 156.05 |
| 3 | −14.86 | 83.20 | 112.20 | 152.40 |

TABLE 1-continued

| Dimensions of various components | | | | |
|---|---|---|---|---|
| No. | K (dB) | D1 | W | B |
| 4 | −15.27 | 83.35 | 110.70 | 148.90 |
| 5 | −15.69 | 83.50 | 109.20 | 145.60 |
| 6 | −16.13 | 83.60 | 107.60 | 142.35 |
| 7 | −16.57 | 83.75 | 106.00 | 139.25 |
| 8 | −17.04 | 83.85 | 104.35 | 136.25 |
| 9 | −17.50 | 83.95 | 102.70 | 133.40 |
| 10 | −17.97 | 84.05 | 101.05 | 130.65 |
| 11 | −18.46 | 84.10 | 99.35 | 127.95 |
| 12 | −18.97 | 84.20 | 97.60 | 125.35 |
| 13 | −19.49 | 84.25 | 95.85 | 122.80 |
| 14 | −20.02 | 84.30 | 94.10 | 120.35 |
| 15 | −20.57 | 84.35 | 92.30 | 117.90 |
| 16 | −21.14 | 84.35 | 90.50 | 115.55 |
| 17 | −21.72 | 84.40 | 88.70 | 113.25 |
| 18 | −22.32 | 84.40 | 86.85 | 111.00 |
| 19 | −22.93 | 84.40 | 85.05 | 108.85 |
| 20 | −23.56 | 84.40 | 83.20 | 106.70 |
| 21 | −24.22 | 84.40 | 81.35 | 104.60 |
| 22 | −24.88 | 84.40 | 79.55 | 102.50 |
| 23 | −25.56 | 84.35 | 77.75 | 100.50 |
| 24 | −26.28 | 84.30 | 75.90 | 98.50 |
| 25 | −27.02 | 84.30 | 74.05 | 96.50 |
| 26 | −27.77 | 84.25 | 72.25 | 94.55 |
| 27 | −28.56 | 84.20 | 70.40 | 92.60 |
| 28 | −29.37 | 84.20 | 68.55 | 90.70 |
| 29 | −30.21 | 84.15 | 66.75 | 88.80 |
| 30 | −31.09 | 84.10 | 64.90 | 86.90 |
| 31 | −32.01 | 84.05 | 63.05 | 85.00 |
| 32 | −32.95 | 84.00 | 61.25 | 83.15 |
| 33 | −33.94 | 83.95 | 59.40 | 81.30 |
| 34 | −34.97 | 83.85 | 57.55 | 79.45 |
| 35 | −36.09 | 83.80 | 55.65 | 77.55 |
| 36 | −37.23 | 83.75 | 53.75 | 75.70 |
| 37 | −38.46 | 83.70 | 51.85 | 73.80 |
| 38 | −39.76 | 83.65 | 49.90 | 71.90 |
| 39 | −41.16 | 83.60 | 47.90 | 69.95 |
| 40 | −42.66 | 83.55 | 45.85 | 68.00 |
| 41 | −44.29 | 83.50 | 43.75 | 66.00 |

As can be seen in FIG. 4, the slot (22) is configured as having a lower section with a generally round cross-section that receives the main conductor (18), and an upper section with a generally rectangular cross-section that receives the coupled conductor (20). The lower, round section of the slot (22) has a substantially constant diameter (D0) of 190.0 mils, with the overall depth (L) of the slot (22) being a generally constant 305 mils. The width (B) of the upper, rectangular section of the slot (22) has a substantially constant taper from 159.95 mils at one end to 66 mils at the other end (see Table 4).

Again with respect to FIG. 4 and Table 1, the main conductor (18) has a diameter (D1) that has a taper from 82.95 mils at one end increasing to a maximum of 84.40 mils adjacent to the center and then back down to 83.5 mils at the other end. However, the main conductor (18) is positioned within the lower, round section of the slot (22) at a substantially constant depth (G) of 210.0 mils.

Still again with respect to FIG. 4 and Table 1, the coupled conductor (20) has a generally rectangular cross-section when taken along its length. The thickness (T) of the coupled conductor (20) remains substantially constant at 20 mils, as does the depth of the top of the coupled conductor (20) within the slot (20) (also 20 mils). However, the height (W) of the coupled conductor (20) has a generally constant taper from 115.10 mils at one end to 43.75 mils at the other end.

It should be noted that Table 1 is specifically directed to an exemplary 20 dB, high-pass coupler with a plus or minus 0.26 dB ripple. The coupling factor (K) at each modeled section is also shown in Table 1 (ranging from −14.05 dB at one end to −44.29 dB at the other end), and the low frequency cut off (L/λ0) is 0.278. It should be understood that these dimensions apply to one exemplary coupler, and are all subject to change with different customer requirements, such as coupling value, power level, insertion loss and frequency range.

The housing (12) and cover (14) may be made of aluminum and combined be about 1.5 inches square, whereas all conductors and connectors may be made of brass. To prevent oxidization and provide good PIM performance and low insertion loss, the brass parts may be silver-plated and the aluminum housing may be protected against corrosion using a chemical conversion coating.

Referring now to Table 2 below, a performance comparison is provided showing various performance metrics of the inventive embodiment described above operating at two different power levels (50 W and 500 W) as compared with prior art devices. Specifically, these prior art devices are the device described in U.S. Pat. No. 7,429,903 (discussed in more detail above) operating at 500 W, as well as a traditional industry standard stripline device operating at 50 W.

TABLE 2

| Performance comparison | | | | | |
|---|---|---|---|---|---|
| Device | Frequency Range (Mhz) | Insertion Loss (dB) | PIM (dBc) | Power (Watts) | Comments |
| U.S. Pat. No. 7,429,903 | 800-2200 | 0.2 | −160 | 500 | Narrow frequency range |
| Applicant's Invention | 1000-18000 | 0.5 | −160 | 500 | Wide band Low Loss High Power Low PIM |
| Traditional Stripline | 1000-18000 | 1.3 | −140 | 50 | High loss Low power |
| Applicant's Invention | 1000-18000 | 0.5 | −150 | 50 | Low loss Wideband Low PIM |

As can be seen in Table 1, the present invention provides benefits over both the device described in U.S. Pat. No. 7,429,903 (discussed in more detail above) and traditional industry standard stripline devices.

Figure 5A:
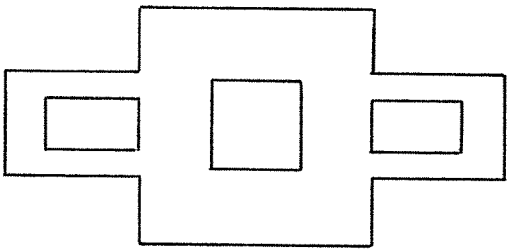
FIGS. 5A-5H are schematic views illustrating various alternative cross-sections of various components of the directional coupler of FIG. 1.
Figure 5B:
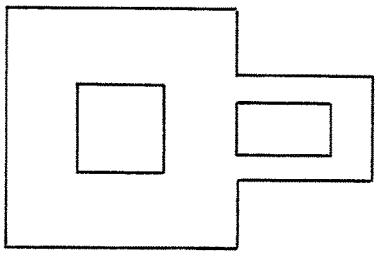
Figure 5C:
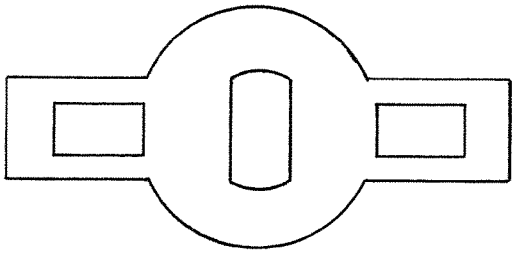
Figure 5D:
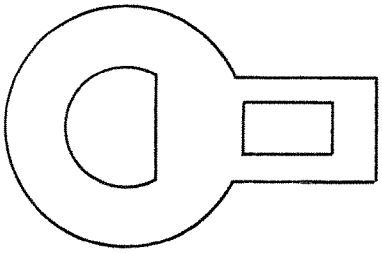
Figure 5E:
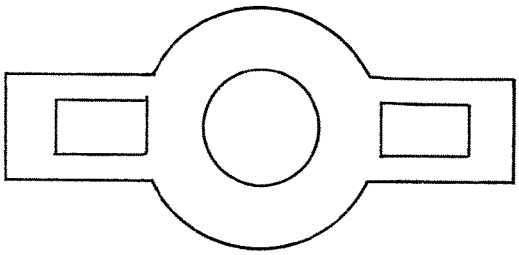
Figure 5F:
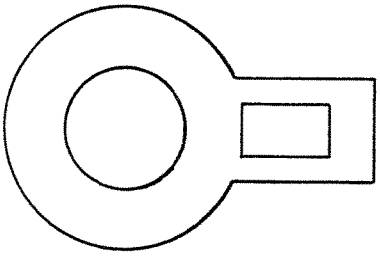

With reference now to FIGS. 5A-5H, it should be understood that the inventive aspects of the present invention may be employed in connection with directional couplers having configurations other than the specific exemplary embodiment described above. For example, the main conductor (18) and or the slot (22) in the housing (12) need not each have a round cross section. Moreover, more than one coupled conductor (20) can be provided. For example, FIG. 5A shows the main conductor having a generally square cross-section, the slot in the housing having a generally square cross-section and two coupled conductors, while FIG. 5B shows the main conductor having a generally square cross-section, the slot in the housing having a generally square cross-section and one coupled conductor. FIG. 5C shows the main conductor having a partially flat, partially rounded cross-section, the slot in the housing having a generally round cross-section and two coupled conductors, while FIG. 5D shows the main conductor having a partially flat, partially rounded cross-section, the slot in the housing having a generally round cross-section and one coupled conductor. FIG. 5E shows the main conductor having a generally round cross-section, the slot in the housing having a generally round cross-section and two coupled conductors, while FIG.

Figure 5G:
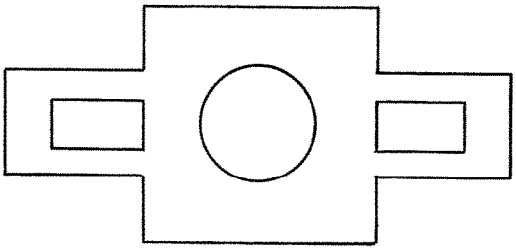
Figure 5H:
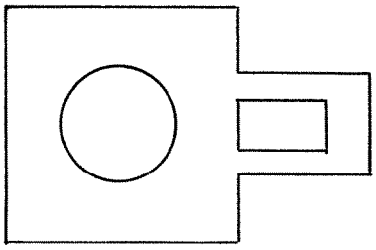

5F shows the main conductor having a generally round cross-section, the slot in the housing having a generally round cross-section and one coupled conductor (as also described and shown in connection with FIGS. 1-4). FIG. 5G shows the main conductor having a generally round cross-section, the slot in the housing having a generally square cross-section and two coupled conductors, while FIG. 5H shows the main conductor having a generally round cross-section, the slot in the housing having a generally square cross-section and one coupled conductor.

Other configurations are also possible without departing from the inventive aspects of the present invention. For example, although not shown, it should be recognized that the cross-sectional shape of the coupled conductor(s) may also be varied.

Although the invention has been described with reference to a particular arrangement of parts, features and the like, these are not intended to exhaust all possible arrangements or features, and indeed many other modifications and variations will be ascertainable to those of skill in the art. Some variation examples include connector type, and combinations of multiple couplers in an assembly.

What is claimed is:

1. A tapered airline directional coupler comprising:

a housing having a length with an input end and an output end disposed at opposite ends of the length, the housing having a slot formed therein extending between the input end and the output end, wherein a cross-sectional area of the slot varies depending upon where the cross-section is taken along the length of the housing;

a main conductor disposed within the slot and extending between the input end and the output end of the housing, the main conductor being in electrical communication with an input port connector mounted on the housing at the input end thereof and with an output port connector mounted on the housing at the output end thereof, the main conductor having a cross-sectional area that varies depending upon where the cross-section is taken along the length of the housing; and a coupled conductor disposed within the slot and spaced apart from the main conductor, the coupled conductor being in electrical communication with and extending between a forward coupling port connector mounted on the housing adjacent to the input end thereof and a reverse coupling port connector mounted on the housing adjacent to the output end thereof, the coupled conductor having a cross-sectional area that varies depending upon where the cross-section is taken along the length of the housing.

2. The directional coupler of claim 1 wherein the slot comprises a lower section with a generally round cross-section that receives the main conductor, and an upper section with a generally rectangular cross-section that receives the coupled conductor.

3. The directional coupler of claim 2 wherein the lower section of the slot has a substantially constant diameter along the length of the housing.

4. The directional coupler of claim 3 wherein a width of the upper section of the slot tapers from a larger width adjacent to the input end of the housing to a smaller width adjacent to the output end of the housing.

5. The directional coupler of claim 4 wherein an overall depth of the slot is generally constant along the length of the housing.

6. The directional coupler of claim 1 wherein the main conductor has a generally circular cross-section regardless of where the cross-section is taken along the length of the housing, and wherein a diameter of the main conductor varies depending upon where the cross-section is taken along the length of the housing.

7. The directional coupler of claim 6 wherein the diameter of the main conductor has a taper from a larger diameter toward a middle of the length of the housing toward smaller diameters toward both the input end of the housing and the output end of the housing.

8. The directional coupler of claim 7 wherein the diameter of the main conductor is larger at the output end of the housing than at the input end of the housing.

9. The directional coupler of claim 8 wherein the main conductor is positioned within the slot at a substantially constant depth along the length of the housing.

10. The directional coupler of claim 1 wherein the coupled conductor has a generally rectangular cross-section regardless of where the cross-section is taken along the length of the housing.

11. The directional coupler of claim 10 wherein a thickness of the coupled conductor remains substantially constant regardless of where the cross-section is taken along the length of the housing.

12. The directional coupler of claim 11 wherein a height of the coupled conductor tapers from a larger height adjacent to the input end of the housing to a smaller height adjacent to the output end of the housing.

13. The directional coupler of claim 12 wherein a depth of an edge of the coupled conductor opposite to the main conductor within the slot remains substantially constant along the length of the housing.

14. The directional coupler of claim 1 wherein the main conductor and the coupled conductor each comprise a solid, one-piece rod.

15. A tapered airline directional coupler comprising:

a housing having a length with an input end and an output end disposed at opposite ends of the length, the housing having a slot formed therein extending between the input end and the output end, the slot having a lower section with a generally round cross-section and an upper section with a generally rectangular cross-section, wherein a width of the upper section of the slot tapers from a larger width adjacent to the input end of the housing to a smaller width adjacent to the output end of the housing;

a main conductor disposed within the lower section of the slot and extending between the input end and the output end of the housing, the main conductor being in electrical communication with an input port connector mounted on the housing at the input end thereof and with an output port connector mounted on the housing at the output end thereof, the main conductor having a generally circular cross-section regardless of where the cross-section is taken along the length of the housing, and wherein the diameter of the main conductor has a taper from a larger diameter toward a middle of the length of the housing toward smaller diameters toward both the input end of the housing and the output end of the housing; and a coupled conductor disposed within the upper section of the slot and spaced apart from the main conductor, the coupled conductor being in electrical communication with and extending between a forward coupling port connector mounted on the housing adjacent to the input end thereof and a reverse coupling port connector mounted on the housing adjacent to the output end thereof, the coupled conductor having a generally rectangular cross-section regardless of where the cross-section is taken along the length of the housing and wherein a height of the coupled conductor tapers from a larger height adjacent to the input end of the housing to a smaller height adjacent to the output end of the housing.

16. The directional coupler of claim 15 wherein the lower section of the slot has a substantially constant diameter along the length of the housing.

17. The directional coupler of claim 15 wherein an overall depth of the slot is generally constant along the length of the housing.

18. The directional coupler of claim 15 wherein the diameter of the main conductor is larger at the output end of the housing than at the input end of the housing.

19. The directional coupler of claim 15 wherein the main conductor is positioned within the slot at a substantially constant depth along the length of the housing.

20. The directional coupler of claim 15 wherein a thickness of the coupled conductor remains substantially constant regardless of where the cross-section is taken along the length of the housing.

21. The directional coupler of claim 15 wherein a depth of an edge of the coupled conductor opposite to the main conductor within the slot remains substantially constant along the length of the housing.

22. The directional coupler of claim 15 wherein the main conductor and the coupled conductor each comprise a solid, one-piece rod.

* * * * *